United States Patent [19]

Suzuki

[11] 4,024,674

[45] May 24, 1977

[54] GUARD DEVICE FOR A GRINDING WHEEL IN A GRINDING MACHINE

[75] Inventor: Yoshinobu Suzuki, Aichi, Japan

[73] Assignee: Toyoda Koki Kabushiki Kaisha, Kariya, Japan

[22] Filed: Dec. 31, 1975

[21] Appl. No.: 645,635

[30] Foreign Application Priority Data

Jan. 22, 1975 Japan ..... 50-11023[U]

[52] U.S. Cl. ..... 51/268; 51/267; 51/272

[51] Int. Cl.² ..... B24B 55/02; B24B 55/04

[58] Field of Search ..... 51/267, 268, 269, 272

[56] References Cited

UNITED STATES PATENTS

| | | | |
|---|---|---|---|
| 385,666 | 7/1888 | Hadley | 51/268 X |
| 1,286,518 | 12/1918 | Brassill | 51/268 X |
| 3,526,998 | 9/1970 | Backer | 51/269 |
| 3,744,189 | 7/1973 | Kakumu | 51/267 |
| 3,835,595 | 9/1974 | Oshima | 51/268 |

FOREIGN PATENTS OR APPLICATIONS

| | | | |
|---|---|---|---|
| 464,241 | 1/1914 | France | 51/267 |

*Primary Examiner*—Al Lawrence Smith
*Assistant Examiner*—Nicholas P. Godici
*Attorney, Agent, or Firm*—Oblon, Fisher, Spivak, McClelland & Maier

[57] ABSTRACT

A guard device has a front cover member which is pivotably mounted upon the upper-front portion of a guard body for covering a rotatable grinding wheel of a grinding machine in co-operation therewith, and also includes a screw shaft and a nut member for adjusting the pivotal position of the front cover member depending upon the amount of wear of the grinding wheel. Coolant dishcarging means is operatively associated with the front cover member so as to be pivoted integrally therewith, rotation of the screw shaft thereby simultaneously bringing the front cover member and the coolant discharging means to a proper position relative to the grinding wheel.

6 Claims, 2 Drawing Figures

GUARD DEVICE FOR A GRINDING WHEEL IN A GRINDING MACHINE

BACKGROUND OF THE INVENTION

1. Field of the Invention

The present invention relates generally to a grinding machine, and more particularly to a guard device, for a grinding wheel, which has a front cover which is adjustable depending upon the decrease in the diameter of the grinding wheel.

2. Description of Prior Art

Within a guard device, as disclosed for example with U.S. Pat. No. 3,835,595, issued to S. Oshima et al., a front cover is pivotably mounted upon the upper-front portion of a guard hood through means of a hinge pin, and an adjusting screw shaft is threadedly engaged with the guard hood, and is also rotatably supported upon the front cover so as to adjust the pivotal position of the front cover in correspondence to the diameter of a grinding wheel.

However, due to the fact that the screw shaft is disposed upon one side of the front cover and the guard hood, a bending moment occurs within the hinge pin and the screw shaft when the pivotal position of the front cover is adjusted, and consequently, the rotational movement of the screw shaft becomes very strained, whereby the front cover is difficult to adjust. Furthermore, since the supporting rigidity of the screw shaft disposed along one side of the front cover is considerably small, it is unavoidable that, at the time of breakage of the grinding wheel, the front cover is necessarily inclined and will subsequently be opened by means of the fragments which violently come into contact with the front cover, and therefore, the guard device cannot positively prevent the front cover from opening.

In addition, since the cover of the guard device overlaps, within the operative state, a pivotable side plate which is pivotably mounted upon the guard hood so as to be selectively opened and closed, such is also apt to obstruct the opening motion of the side plate, and consequently, replacement of the grinding wheel from the wheel carrier is also difficult to perform.

SUMMARY OF THE INVENTION

Accordingly, it is an object of the present invention to provide an improved guard device which is easy to manipulate.

Another object of the present invention is to provide an improved guard device within which pivotal adjustments of a front cover and coolant discharging means are simultaneously achieved by means of a rotatable adjusting screw.

Still another object of the present invention is to provide an improved guard device of the type which can positively prevent the front cover from opening even in the event that a grinding wheel breaks and within which the pivotal adjustment of the front cover may be easily performed.

A further object of the present invention is to provide an improved guard device of the type within which a laterally pivotable guard plate does not become obstructed by the front cover when opened in order to replace a grinding wheel from a wheel carrier.

Briefly, the foregoing and other objects of the present invention are attained through the provision of a guard device which comprises a guard body, a lateral guard plate, and a pivotable front cover, which cover a rotatable grinding wheel of a grinding machine in cooperation with one another and which also includes a screw shaft and a nut member for adjusting the pivotal position of the front cover. The front cover is pivotably mounted upon the upper-front portion of the guard body, with the lowermost end thereof movable toward and away from the outer periphery of the grinding wheel, and is associated with coolant discharging means so as to be pivoted integrally therewith, the discharging means being for discharging a coolant fluid toward the grinding point or position. Accordingly, by rotating the screw shaft, the front cover and the discharging means can be simultaneously adjusted whereby bothersome dual adjustments may be eliminated. Furthermore, the guard device has, according to another aspect of the present invention, the screw shaft disposed just over the grinding wheel so as to engage the nut member, at both sides thereof with the front cover. Thus, not only the rigidity, but also the ease and smoothness of the pivotal movement of the front cover, can be remarkably enhanced.

BRIEF DESCRIPTION OF THE DRAWINGS

Various other objects, features and attendant advantages of the present invention will be more fully appreciated as the same becomes better understood from the following detailed description when considered together with the accompanying drawings, in which like reference characters designate like or corresponding parts throughout the several views, and wherein.

DETAILED DESCRIPTION OF A PREFERRED EMBODIMENT

Figure 1:
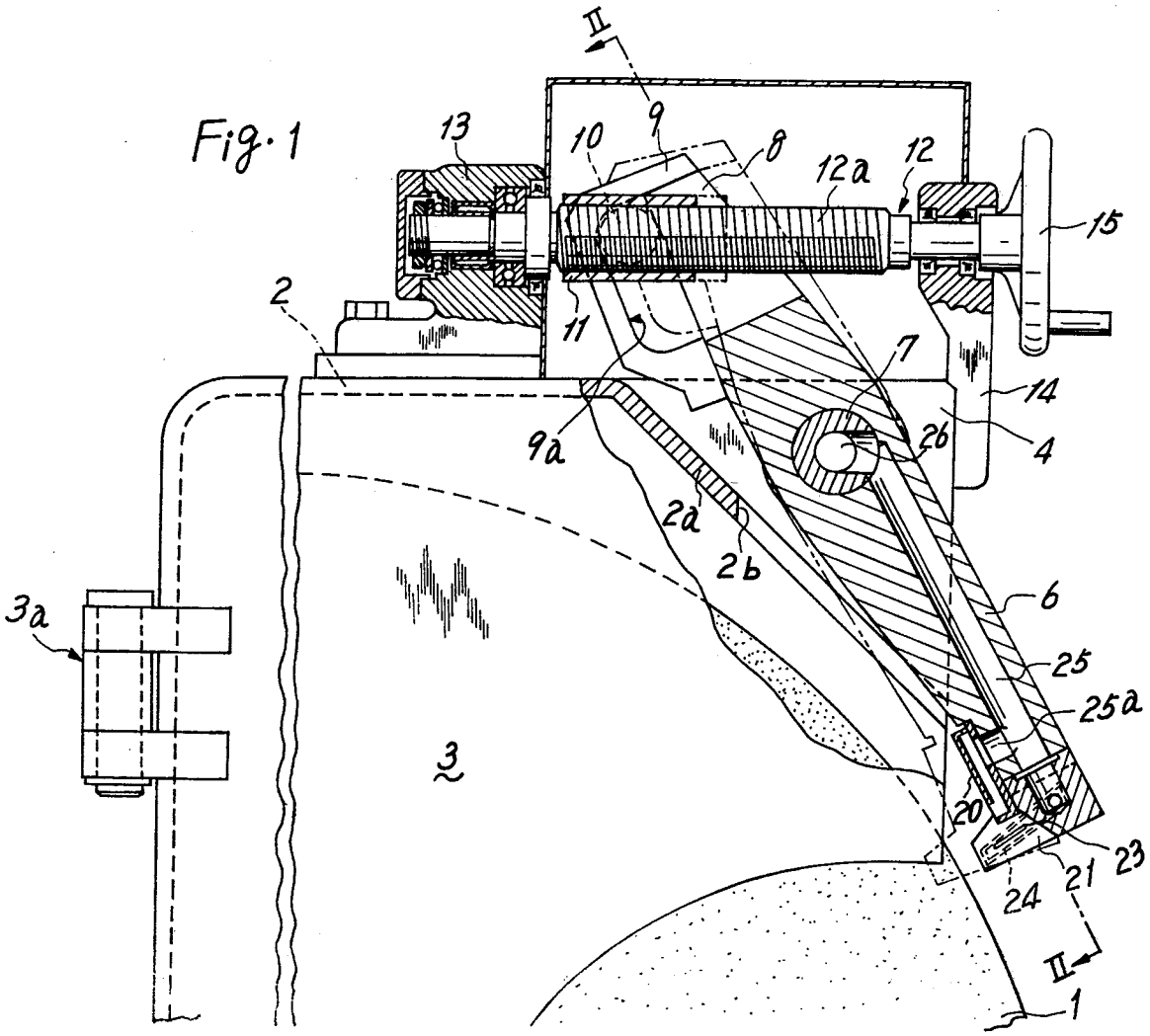
FIG. 1 is a side elevational view, partly in cross-section, of a guard device constructed according to the present invention and showing its cooperative parts.
Figure 2:
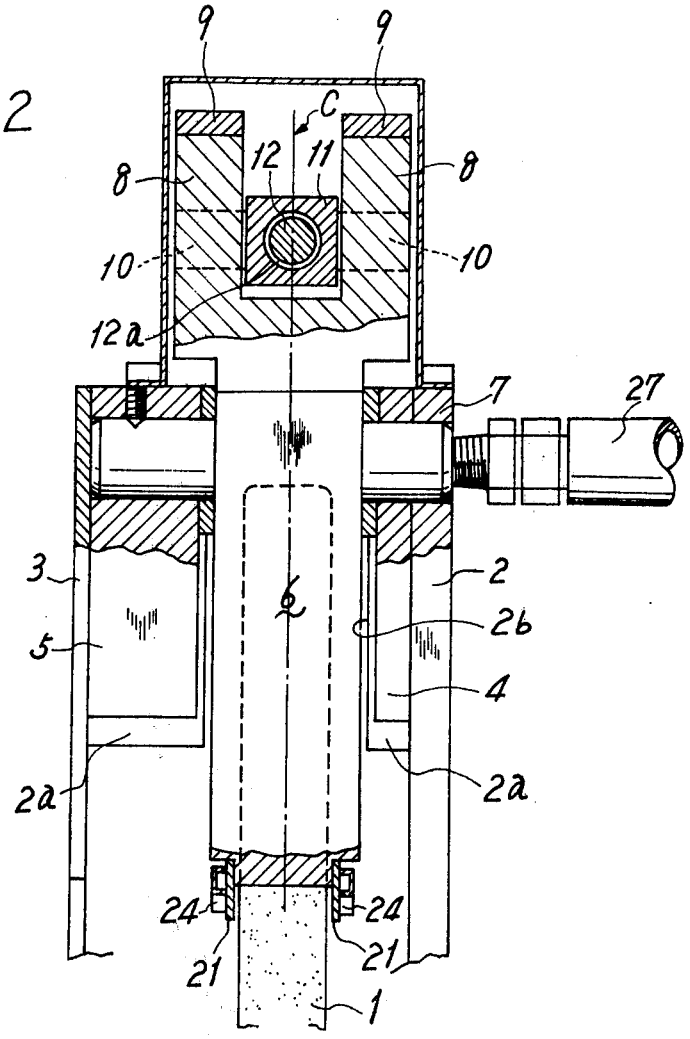
FIG. 2 is a fragmentary cross-sectional view of the device of FIG. 1 taken along the line II—II of FIG. 1.

Referring now to the drawings, and more particularly to FIGS. 1 and 2 thereof, a grinding wheel 1 is rotatably mounted, so as to be motor-driven, upon a wheel slide, not shown, of a cylindrical grinding machine, and the wheel slide also fixedly mounts thereon a guard body 2 for covering the upper, lower, and rear portions, as well as one side face, of the grinding wheel 1. A lateral guard plate 3, for covering the other side face of the grinding wheel 1, is pivotably mounted upon the guard body 2 through means of a hinge device 3*a* so as to be selectively opened and closed, and at the upper-front portion of the guard body 2, there is provided a forwardly sloped portion 2*a*, from both sides portions of which triangular support brackets 4 and 5 are vertically disposed and supported. A front cover member 6, for covering the forward part of the grinding wheel 1, is pivotably supported upon, and interposed between, the support brackets 4 and 5 by means of a hollow hinge shaft 7 so as to be angularly adjustable, cover 6 being adapted to project into a cutout portion 2*b* formed within the sloped portion 2*a* when the cover 6 is in its lowermost pivoted position.

Upon the uppermost end of the front cover member 6, a pair of guides 8, having a U-shaped configuration as viewed from the front of the guard device, are provided, as best shown in FIG. 2, to which detaining members 9 are respectively securely attached, each of which has a C-shaped configuration, as viewed from one side of the guard device, in order to provide a guide slot 9a for operative co-operation with the respective guides 8. Drive pins 10 respectively protrude, in a direction parallel with the hinge shaft 7 and in opposite directions with respect to each other, from opposite sides of a travelling nut member 11 which is threadedly engaged with a screw shaft 12 and is interposed between the guides 8, and are disposed respectively into the guide slots 9a, so as to be slidable along and within the same.

The nut member 11 is threadedly engaged with a screw portion 12a of the adjusting screw shaft 12 which is disposed above the guard body 2 in a co-planar manner with grinding wheel 1 so as to be disposed transversely with respect to the hinge shaft 7 and to pass through the middle portion of the guides 8, the co-planar positional relationship between shaft 12 and wheel 1 being disclosed at C within FIG. 2. It is therefore to be noted that the screw shaft 12 can rigidly support the front cover member 6 so as to facilitate the smooth movement of the same. One end of the screw shaft 12 is rotatably journalled, without freedom of axial movement, within a bearing housing 13 which is fixed upon the guard body 2, and the other end thereof is rotatably journalled within an auxiliary support member 14 fixed upon the support brackets 4 and 5, a handle wheel 15 being integrally connected thereto.

Upon the lowermost end of the front cover member 6, there is fixedly provided a main coolant nozzle 20 which faces the grinding wheel 1 so as to discharge coolant fluid toward the outer periphery thereof, and baffle plates 21 extend respectively alongside the side faces of the grinding wheel 1 so as to prevent scattering of the discharged coolant fluid. The baffle plates 21 onstitute component parts of respective auxiliary coolant nozzles 24 whose nozzle jets 23 are open and directed so as to respectively discharge the coolant fluid toward the side faces of the grinding wheel 1 and to thereby intercept entrained air flows which move along in the circumferential direction with the side faces of the wheel 1 and adjacent to the outer periphery of the wheel.

The auxiliary coolant nozzles 24 are in fluidic communication wth a fluid passage 25 which is bored within the front cover member 6, and to which an internal passage 26 of the hinge shaft 7 is also communicated, which is, in turn, fluidically communicated with a coolant supply source, not shown, through means of a conduit 27. In addition, there is provided a branch passage 25a interposed between the main coolant nozzle 20 and the fluid passage 25, and in this manner, the supply of the coolant fluid to the nozzles 20 and 24 can be accomplished through utilization of the front cover member 6.

The operation of the device, constructed as described hereinabove, will now be described. Assuming that the grinding wheel 1 is a new one, adjustment of the front cover member 6 is performed prior to subsequent grinding operations. When the handle wheel 15 is rotated in the clockwise direction, the nut member 11, engaged upon the screw portion 12a of the screw shaft 12, travels rightward as viewed in FIG. 1, and thus, the drive pins 10 push the guides 8 toward the right, with the pins themselves sliding within the guide slots 9a defined by means of guides 8 and the detaining members 9, and consequently, the front cover member 6 is pivoted in the clockwise direction from the original position shown within FIG. 1 to a proper position, as indicated by the phantom line, which depends upon the diameter of the grinding wheel 1.

Whenever a grinding operation with the grinding wheel 1 is performed upon the workpiece, not shown, coolant fluid is discharged from the nozzles 20 and 24 toward the outer periphery and side faces of the grinding wheel 1 through means of conduit 27, internal bore 26, and the fluid passage 25, and at such time, the baffle plates 21 may serve to prevent the coolant fluid discharged from the main nozzle 20 from deviating or scattering in directions other than toward the grinding wheel 1, and the coolant fluid, which is discharged toward the side faces of the grinding wheel 1, may intercept the air currents rotatably entrained together with the side faces of the wheel so as to sufficiently and exactly supply the coolant fluid to the grinding point or position.

The repetition of the grinding operation results in a decrease in the diameter of the grinding wheel 1 since a number of dressing operations are performed, and it therefore becomes necessary to compensate the pivotal position of the front cover member 6. Accordingly, the compensation is, when necessary, performed in a manner similar to that described above wherein the handle wheel 15 is rotated in the clockwise direction, and consequently, a re-adjustment of the front cover member 6 is made. The repetition of the grinding operation, moreover, requires the exchange of the grinding wheel 1 with a new wheel in due course, and for the purpose of such an exchange, the handle wheel 15 is rotated in the counterclockwise direction until the front cover member 6 returns to its original position shown within FIG. 1, and thereafter, another grinding wheel may be mounted upon the wheel carrier in lieu of the used wheel.

Although the screw shaft 12 is manually rotated within the above embodiment, it may also be intended that in addition to the handle wheel 15, or in lieu of the same, power means may be provided upon the guard body 2 so as to automatically drive the screw shaft 12 and/or to automatically adjust the front cover member 6 as a result of a dressing operation.

Obviously, many modifications and variations of the present invention are possible in light of the above teachings. It is to be understood therefore that within the scope of the appended claims, the present invention may be practiced otherwise than as specifically described herein.

I claim:

1. A guard device for a grinding wheel in a grinding machine comprising:

a guard body for covering said grinding wheel rotatably mounted upon a wheel carrier and having a lateral opening defined therein;

a lateral guard plate mounted upon said guard body for covering said lateral opening;

a front cover member provided for covering the upper-front portion of said grinding wheel and pivotably mounted upon said guard body, with the lowermost end thereof movable toward and away from the outer periphery of said grinding wheel;

coolant discharging means provided for discharging a coolant fluid toward said grinding wheel and mounted upon said front cover member so as to be moved integrally therewith;

a hollow pivot shaft provided for pivotably supporting said front cover member upon said guard body and having an internal bore fluidically communicated with said coolant discharging means;

a screw shaft rotatably supported upon said guard body, with the axis thereof extending in a transverse direction with respect to said pivot shaft of said front cover member; and a nut member threadedly engaged with the screw shaft and adapted to pivotably move said front cover member through the movement thereof caused by the rotation of said screw shaft so as to adjust the position of said coolant discharging means and said front cover member with respect to said grinding wheel.

2. A guard device as claimed in claim 1, wherein said coolant discharging means comprises:

a main coolant nozzle for discharging said coolant fluid to the outer periphery of said grinding wheel; and a pair of auxiliary coolant nozzles provided with nozzle jets which are directed respectively toward the side faces adjacent to the outer periphery of said grinding wheel so as to respectively supply coolant fluid to said side faces of said grinding wheel.

3. A guard device as claimed in claim 2, wherein:

a pair of baffle plates are further provided upon the lowermost end of said front cover member so as to face side faces of said wheel adjacent to the outer periphery of said grinding wheel.

4. A guard device as claimed in claim 2 wherein:

said screw shaft extends over said guard body and in a direction extending from the front toward the rear thereof.

5. A guard device as claimed in claim 4, wherein:

said nut member is provided upon the opposed lateral surfaces thereof with a pair of projections extending parallel to said pivot shaft; and said front cover member is formed at the uppermost end thereof with a U-shaped portion which engages with said pair of projections of said nut member.

6. A guard device as claimed in claim 5, wherein:

said lateral guard plate is operable to be opened at the time of replacing said grinding wheel from said wheel carrier; and said front cover member is interposed between a lateral plate portion of said guard body and said lateral guard plate, whereby the lateral guard plate can be opened irrespective of any pivotal position of said front cover member.

* * * * *